US007065825B2

(12) United States Patent
Minkler et al.

(10) Patent No.: US 7,065,825 B2
(45) Date of Patent: Jun. 27, 2006

(54) CLEANING TOOL WITH GRIPPING ASSEMBLY FOR A DISPOSABLE SCRUBBING HEAD

(75) Inventors: Douglas J. Minkler, Pleasanton, CA (US); Russell E. Bell, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 124 days.

(21) Appl. No.: 10/602,478

(22) Filed: Jun. 23, 2003

(65) Prior Publication Data

US 2004/0255418 A1 Dec. 23, 2004

(51) Int. Cl.
*A47L 13/10* (2006.01)
*A47K 11/10* (2006.01)

(52) U.S. Cl. ..... 15/210.1; 15/147.1; 15/244.1

(58) Field of Classification Search ..... 15/104.93, 15/104.94, 147.1, 147.2, 150–152, 210.1, 15/209.1, 244.1
See application file for complete search history.

(56) References Cited

U.S. PATENT DOCUMENTS

| | | | | |
|---|---|---|---|---|
| 2,402,577 | A * | 6/1946 | Rodgers | 15/210.1 |
| 4,075,033 | A * | 2/1978 | Knox et al. | 134/6 |
| 4,457,038 | A | 7/1984 | Hammond | 15/145 |
| 4,466,152 | A | 8/1984 | Moss et al. | 15/229.2 |
| 4,493,124 | A | 1/1985 | Agapion | 15/104.94 |
| 4,642,836 | A | 2/1987 | Bokmiller | 15/118 |
| 4,852,201 | A | 8/1989 | Wundrock et al. | 15/145 |
| 5,381,809 | A | 1/1995 | Parker, Jr. | 134/113 |
| 5,407,594 | A | 4/1995 | Fry et al. | 510/439 |
| 5,471,697 | A | 12/1995 | Daconta | 15/104.94 |
| 5,658,874 | A | 8/1997 | Davies et al. | 510/446 |
| 5,862,565 | A | 1/1999 | Lundstedt | 15/220.1 |
| 5,888,002 | A | 3/1999 | Fenstersheib | 401/28 |
| 5,941,379 | A | 8/1999 | Barardo | 206/209 |
| 5,945,076 | A | 8/1999 | Leonard et al. | 422/300 |
| D413,470 | S | 9/1999 | Burton | D6/55 |
| 6,094,771 | A | 8/2000 | Egolf et al. | 15/210.1 |
| 6,154,913 | A | 12/2000 | Burton | 15/160 |
| 6,191,100 | B1 | 2/2001 | Askew et al. | 510/504 |
| RE37,190 | E | 5/2001 | Stowell et al. | 16/422 |
| 6,295,688 | B1 | 10/2001 | Sayles | 15/210.1 |

(Continued)

FOREIGN PATENT DOCUMENTS

| | | |
|---|---|---|
| EP | 0 313 495 | 10/1988 |

(Continued)

*Primary Examiner*—Richard Crispino
*Assistant Examiner*—Laura C Guidotti
(74) *Attorney, Agent, or Firm*—Richard Niehuser

(57) ABSTRACT

A cleaning tool assembly including a disposable cleaning implement having a liquid soluble, relatively rigid engaging surface, and an elongated shaft having a handle portion on one end thereof. A gripping mechanism is mounted to the elongated shaft, and includes a contact region moveable between a gripping condition and a release condition. In the gripping condition, the contact region cooperates with the engaging surface of the cleaning implement to releasably mount the cleaning implement to the elongated shaft, and in the release condition, the cleaning implement is released from the gripping mechanism. An elastic boot is provided which is composed of a substantially liquid impervious material. This boot is configured to extend substantially over the contact region of the gripping mechanism such that when and gripping mechanism is in the gripping condition, the contact region urges the elastic boot against the engaging surface of the cleaning implement to form a substantially liquid-tight seal therebetween to substantially delay solubility of the engaging surface during liquid immersion and use of the cleaning implement.

61 Claims, 11 Drawing Sheets

U.S. PATENT DOCUMENTS

| | | | | |
|---|---|---|---|---|
| 6,313,086 | B1 | 11/2001 | Askew et al. | 510/478 |
| 6,355,607 | B1 | 3/2002 | Rahman et al. | 510/446 |
| 6,405,403 | B1 | 6/2002 | McKay | 15/228 |
| 6,413,928 | B1 | 7/2002 | Painter et al. | 510/446 |
| 6,426,111 | B1 | 7/2002 | Hirsch | 426/590 |
| 6,523,213 | B1 | 2/2003 | Post | 15/220.1 |
| 2002/0007527 | A1 | 1/2002 | Hart | 15/104.94 |
| 2002/0032137 | A1 | 3/2002 | DeSenna et al. | 510/194 |
| 2002/0061831 | A1 | 5/2002 | Kaziska et al. | 510/446 |
| 2002/0083542 | A1 | 7/2002 | Hart | 15/210.1 |
| 2002/0173442 | A1 | 11/2002 | Smith et al. | 510/438 |
| 2004/0244130 | A1* | 12/2004 | Kim | 15/104.94 |

FOREIGN PATENT DOCUMENTS

| | | |
|---|---|---|
| EP | 1 254 950 | 11/2000 |
| JP | 09-135728 | 5/1997 |
| WO | WO 87/00411 | 1/1987 |
| WO | WO 00/34422 | 6/2000 |
| WO | WO 00/71012 | 11/2000 |
| WO | WO 01/15587 | 3/2001 |
| WO | WO 01/26499 | 4/2001 |
| WO | WO 01/30954 | 5/2001 |
| WO | WO 01/43618 | 6/2001 |
| WO | WO 01/49818 | 7/2001 |

* cited by examiner

CLEANING TOOL WITH GRIPPING ASSEMBLY FOR A DISPOSABLE SCRUBBING HEAD

FIELD OF THE INVENTION

The present invention relates to cleaning tools, and more particularly, relates to toiletry cleaning tools adapted to grip and maneuver disposable scrubbing heads.

BACKGROUND OF THE INVENTION

Due to heath and sanitation concerns, lavatory facilities, such as toilets and urinals, are routinely cleaned. Such cleansing not only precludes the spread of infections and disease in commercial and public establishment, but also prevents or reduces unpleasant odors in residential facilities. The routine application of deodorizers and disinfectants aim to maintain a fresh and substantially germ-free environment.

Typically, special toilet bowl brushes and cleaning solutions are applied to all surfaces of the toilet to perform effective cleansing. Generally, these cleaning devices include an elongated handle with a brush head or the like mounted to the distal end thereof. These heads enable cleaning inside the bowl and drain without physically contacting the toilet. One particularly unpleasant task, however, involves the cleaning of underside of the lip and rim portion of the toilet bowl. To reduce tactile contact, and required entry into the bowl, toilet brushes are often angled at the brush head which aids reaching such undersides of the rim. Moreover, the containers for the disinfecting and deodorizing solutions are also often angled or have "duck neck" spouts to achieve delivery of the solutions to the undersides of the rim.

Regardless of what chemical process or solutions are applied, some amount of physical scrubbing contact with the brush is necessary to effectively remove stains and deposits. Thus, after disinfecting and deodorizing solutions have been applied, the special toilet bowl brush is utilized to brush and scrub the bowl surfaces as mentioned. While this time tested technique is adequate to disinfect and clean the toilet facilities, several inherent problems with this arrangement exist. For example, once the bowl has been cleaned, the brush is typically rinsed or allowed to drip dry before storage or further use. Accordingly, any infectious germs which may have been collected on the tool are likely to remain in some part on the brush, and are likely to be transported along with the brush.

Moreover, this cleaning arrangement is potentially dangerous in that these toxic, liquid disinfectants and deodorizers pose serious heath hazards. Such cleansers, which are either acidic or caustic, are typically stored under the sink, and may be accessible to unknowing small children. In severe cases of scale removal, highly acidic concentrations of solution, containing hydrochloric or hydrofluoric acids, may be necessary. Such use requires additional safety gear such as protective gloves and protective eye-goggles.

Accordingly, there is a need for a cleaning tool that reduces, if not eliminates, the transmission of infectious germs and from one location to another, as well as reduces the potential health hazards associated with liquid disinfectants and deodorizers.

SUMMARY OF INVENTION

The present invention provides a cleaning tool assembly adapted to removably mount a disposable cleaning implement thereto. In one specific embodiment, the cleaning implement includes a liquid soluble or liquid dispersible, relatively rigid engaging surface. The tool assembly includes an elongated shaft having a handle portion on one end thereof. A gripping mechanism is mounted to the elongated shaft, and includes a contact region moveable between a gripping condition and a release condition. In the gripping condition, the contact region of the gripping mechanism cooperates with the engaging surface of the cleaning implement to releasably mount the cleaning implement to the elongated shaft. In the release condition, the cleaning implement is released from the gripping mechanism. The tool assembly further includes an elastic boot composed of a substantially liquid impervious material and configured to extend substantially over the contact region of the gripping mechanism such that when the gripping mechanism is in the gripping condition, the contact region urges the elastic boot against the engaging surface of the cleaning implement to form a substantially liquid-tight seal therebetween. Such a seal substantially delays solubility or liquid contact of the engaging surface during liquid immersion and use of the cleaning implement.

Accordingly, the gripping mechanism first performs the function of securing the tool assembly to the cleaning implement for useful work thereof. Secondly, the gripping mechanism which is disposed inside the elastic boot operates to positioned the boot against the engaging surfaces of the cleaning implement in a manner significantly delaying liquid contact therewith. The integrity of the gripping contact between the gripping mechanism/elastic boot and the engaging surface can thus be maintained for greater periods, and more useful work can delivered from one cleaning head before disposal is required.

In specific embodiment, the gripping mechanism includes an expandable collet device, providing the contact region, that is adapted for expansion from the release condition to the gripping condition. The contact region of the collet device, in this gripping condition, contacts a backside surface of the elastic boot to urge a topside surface thereof into gripping contact with the engaging surface of the cleaning implement from gripping thereof. The contact region of the collet device is generally elliptical-shaped to substantially conform with the elliptical-shape of the opening and engaging surface defining a gripping cavity of the cleaning implement. This geometric arrangement simplifies orientation and alignment during mounting of the cleaning implement to the tool. Further, upon radial expansion of the collet device in the gripping cavity to the gripping condition, the boot is expanded radially outward into gripping contact with the engaging surface for gripping and formation of the liquid tight seal therewith.

In another configuration, the collet device of the gripping mechanism includes a plurality of finger members extending distally from the handle member. These fingers are positioned generally radially around a longitudinal axis of the collet device, the outer contact region each of which collectively form a transverse cross-sectional dimension substantially conforming to elliptical shape of the cavity opening. When oriented in the release condition, the finger members are formed and dimensioned to collectively, slideably insert into the gripping cavity of the cleaning implement when the gripping mechanism is situated in the release condition.

In still another specific embodiment, the gripping mechanism includes a plunger mechanism having a plunger head disposed for relative reciprocating movement along the longitudinal axis of the collet device between a disengaged condition and an engaged condition. The plunger head includes a cam surface that contacts an opposed underside displacement surface of the finger member. This contact causes the respective contacting regions to move radially outward from the release condition toward the gripping condition where they engage the engaging surfaces of the cleaning implement.

The cleaning assembly may include a force limiting device cooperating with the gripping mechanism to limit the engaging force applied to the engaging surface of the cleaning implement by the collet contact region. This is beneficial to limit the radial gripping force applied to the frangible cleaning implement. The force limiting device may include a plunger mechanism that is adapted for movement relative the shaft along the collet longitudinal axis between a retracted condition and an extended condition, extending the plunger head away from the shaft, while in the retracted condition. To bias the plunger head toward the extended condition, the force limiting device includes a plunger biasing device cooperating with the plunger mechanism.

Another embodiment includes an elastic boot composed of a relatively thin, substantially liquid impervious material having a nipple portion sized and dimensioned for sliding receipt through the opening and into the gripping cavity of the cleaning head. The boot further includes a peripheral collar portion extending radially outward from a base of the boot nipple portion, When the nipple portion of the boot is inserted into the gripping cavity; the collar portion extends radially beyond the cavity opening to enable sealing with the support surface of the cleaning implement.

Another gripping mechanism arrangement includes a biasing device, which is provided by a compression spring, that is adapted to bias the gripping mechanism toward the release condition. In another example, the collet device is slideably mounted to the elongated shaft of the gripping tool. The biasing device then urges the collet device toward the released condition.

In another aspect of the present invention, a maneuvering tool is provided that is adapted to removably secure a disposable, liquid soluble cleaning head thereto. The cleaning head includes a support surface defining an elliptical-shaped opening into a gripping cavity thereof. The gripping cavity further defines by a back wall and a relatively rigid, inwardly facing, side engaging surface extending between the support surface and the back wall. The maneuvering tool includes an elongated shaft having a handle portion on one end thereof, and an internal gripping mechanism mounted to the elongated shaft. The gripping mechanism includes a collet device having an expansive, circumferential, outward facing contact region sized and dimensioned for sliding insertion through the elliptical-shaped opening and into the gripping cavity when oriented in a release condition. The gripping mechanism is selectively movable between the release condition and a gripping condition. The outward facing contact region is thus displaced radially outward from a longitudinal axis of the collet device and into gripping cooperation with the inwardly facing, side engaging surface to provide a substantially uniform engaging force therebetween for mounting of the cleaning head during operation.

In still another aspect of the present invention, a cleaning tool assembly is provided that includes a disposable cleaning implement having a liquid soluble, relatively rigid engaging surface, and an elongated shaft having a handle portion on one end thereof. A gripping mechanism is mounted to the elongated shaft, and includes a contact region moveable between a gripping condition and a release condition. In the gripping condition, the contact region cooperates with the engaging surface of the cleaning implement to releasably mount the cleaning implement to the elongated shaft, and in the release condition, the cleaning implement is released from the gripping mechanism. The tool assembly further includes an elastic boot composed of a substantially liquid impervious material and is configured to extend substantially over the contact region of the gripping mechanism. When the gripping mechanism is in the gripping condition, the contact region urges the elastic boot against the engaging surface of the cleaning implement to form a substantially liquid-tight seal therebetween to substantially delay solubility of the engaging surface during liquid immersion and use of the cleaning implement.

BRIEF DESCRIPTION OF THE DRAWINGS

The assembly of the present invention has other objects and features of advantage which will be more readily apparent from the following description of the best mode of carrying out the invention and the appended claims, when taken in conjunction with the accompanying drawing, in which:

DETAILED DESCRIPTION OF THE INVENTION

Figure 1:
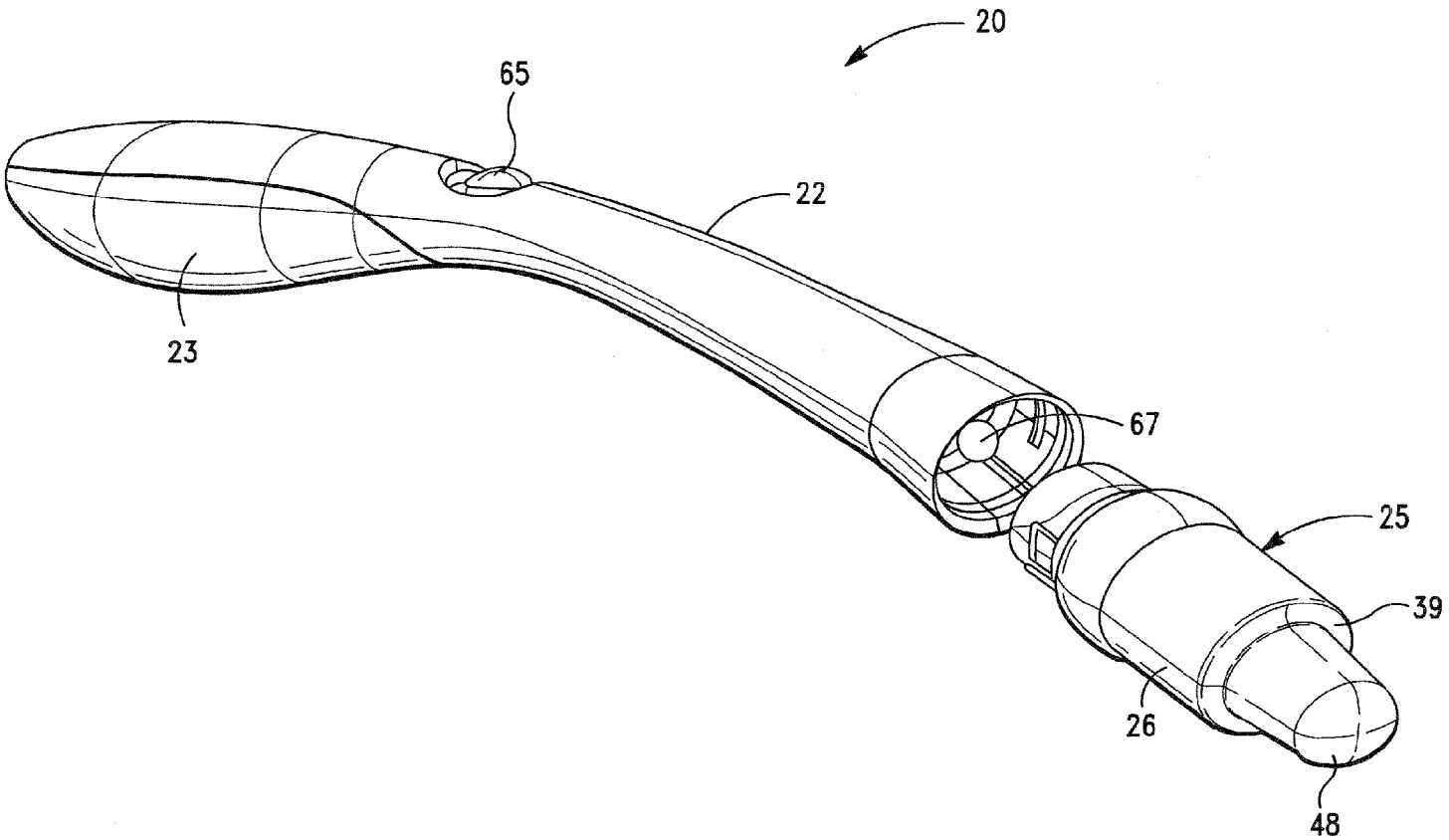
FIG. 1 is a partially exploded, top perspective view of a cleaning tool assembly constructed in accordance with the present invention.
Figure 2:
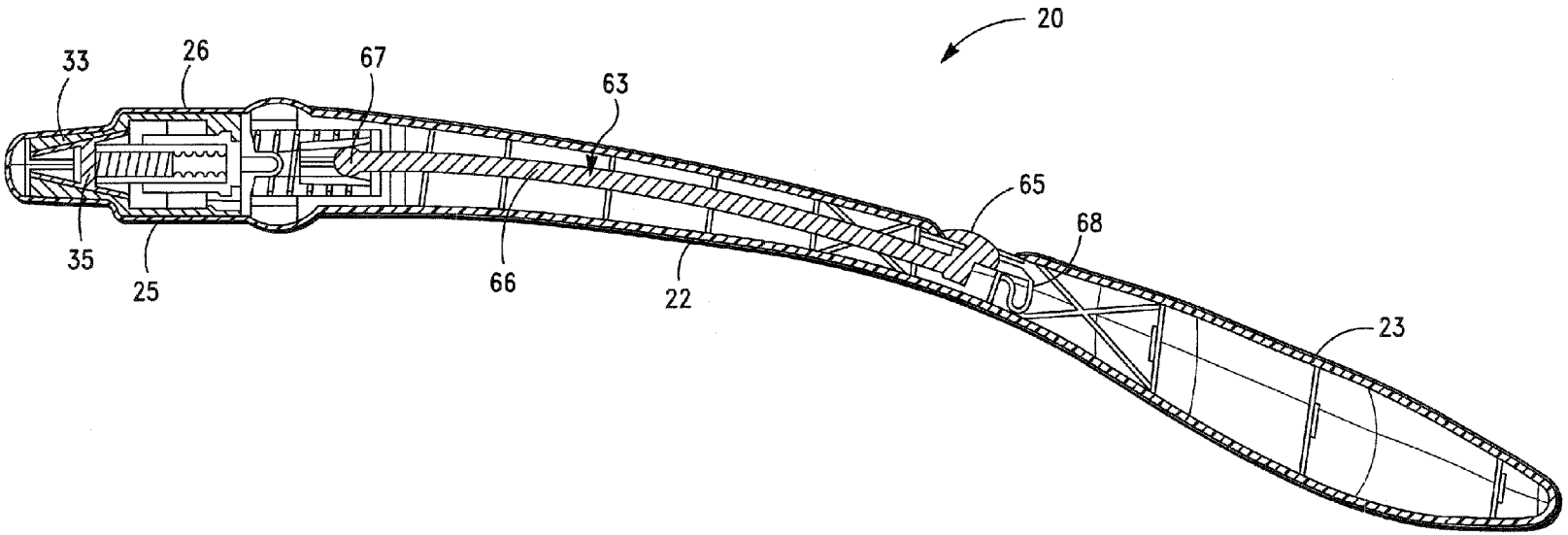
FIG. 2 is a side elevation view, in cross-section, of the cleaning tool assembly of FIG. 1.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Referring now to FIGS. 1–3 and 5, a cleaning tool assembly, generally designated 20, is illustrated which is adapted to removably mount a disposable cleaning implement 21 thereto. The tool assembly includes an elongated shaft 22 having a handle portion 23 on one end thereof, and a gripping mechanism 25 mounted to the other end of the shaft. The gripping mechanism 25 includes a contact region 27 moveable between a release condition (FIGS. 5A and 5F) and a gripping condition (FIG. 5D). In the gripping condition, the contact region 27 cooperates with an engaging surface 28 of the cleaning implement 21 to releasably mount the cleaning implement 21 to the elongated shaft 22. In contrast, in the release condition, the cleaning implement 21 is released from the gripping mechanism 25 for discarding and/or replacement of the implement. The cleaning tool assembly further includes an elastic boot, generally designated 26, which is composed of a substantially liquid impervious material and is disposed substantially over the contact region 27 of the gripping mechanism 25. Thus, when the gripping mechanism 25 is moved to the gripping condition, the contact region 27 urges the elastic boot against the relatively rigid engaging surface 28 of the cleaning implement 21 to form a substantially liquid-tight seal therebetween. This seal substantially delays detrimental contact of any liquids with the engaging surface of the cleaning implement during liquid immersion and use thereof.

Accordingly, such delay of liquid contact with the engaging surfaces of the cleaning implement is beneficial to maintain the integrity of the gripping contact between the gripping mechanism/elastic boot and the engaging surface. This is especially important when the engaging surface of the cleaning implement is partially or entirely liquid soluble, as will be discussed. In such situations, the delay of liquid contact will of course delay dissolution of the engaging surface. Consequently, sufficient gripping contact with the gripping mechanism can be further maintained to enable useful work from the cleaning implement for a longer period before disposal is required.

Figure 5A:
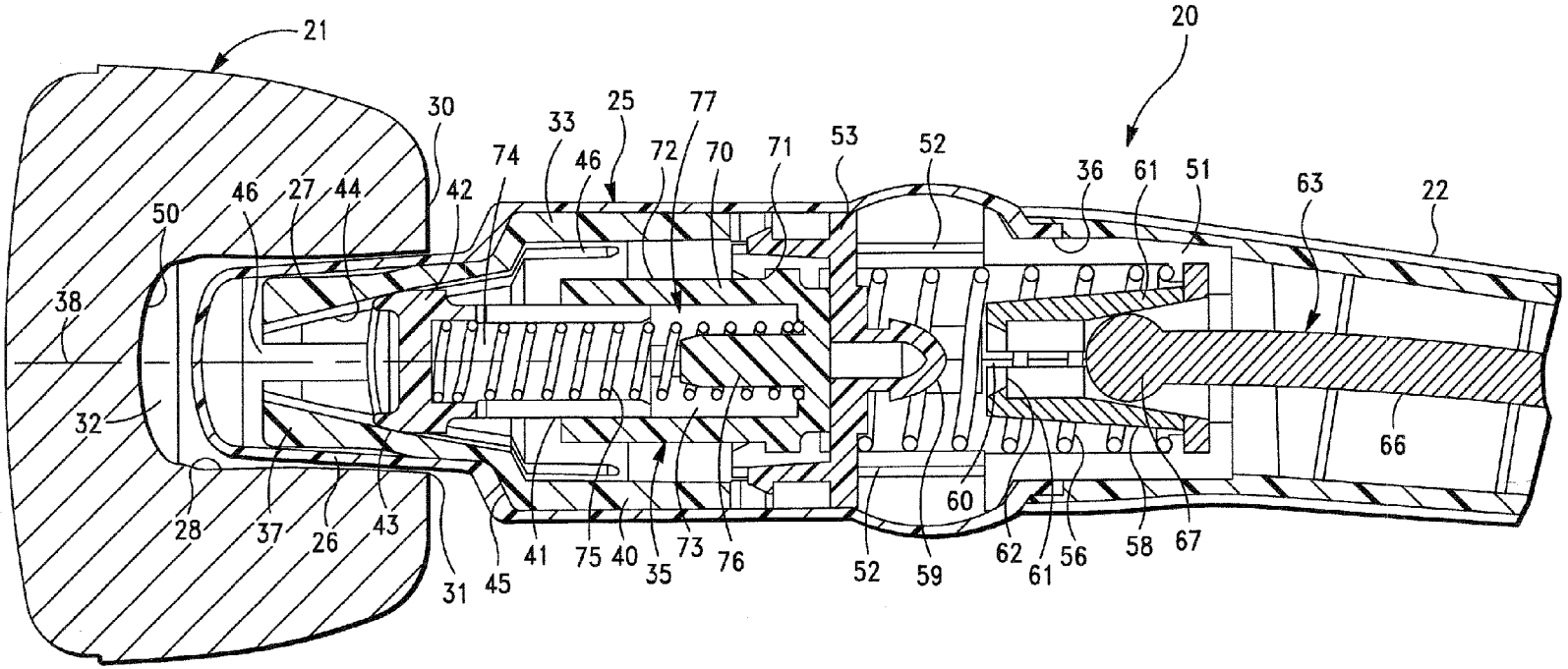
FIGS. 5A–5F are a sequence of enlarged side elevation views of the cleansing tool assembly of FIG. 2 illustrating mounting operation of the gripping mechanism to a cleaning implement.

Referring back to FIG. 1, the tool assembly 20 is shown having an elongated shaft 22 with the handle portion 23 on one end so that the user can handle and manipulate the cleaning implement 21. At the opposite end of the shaft is the gripping mechanism 25 that is configured to releasably grip the cleaning implement. Briefly, although the present invention elastic boot/gripping mechanism arrangement can be easily adaptable to external mount-type cleaning implement or heads 21, this gripping arrangement is particularly suitable for use with internal mount-type cleaning heads 21. That is, as shown in FIG. 5D, the cleaning head 21 provides a rear support surface 30 which defines an opening 31 into a gripping cavity 32 together with an interior facing engaging surface 28.

In one specific example, the opening 31 into the gripping cavity is elliptical-shaped (FIG. 6) which provides physical and geometric gripping advantages that will be described in greater detail below. Extending downwardly from the opening 31 into the gripping cavity 32 is the relatively rigid, inwardly facing, engaging surface 28 that intersects a bottom wall of the cleaning head. The curvilinear engaging surfaces generally retain the elliptical shape of the opening 31, and provide the structural integrity necessary to cooperate with the gripping mechanism for useful gripping of the head. As mentioned above, it is this internal, elliptically-shaped, engaging surface 28 that the gripping mechanism 25 and elastic boot 26 engage against to delay liquid contact therewith upon submergence of the cleaning head 21 during use. Such delay of liquid contact maintains the gripping integrity between the gripping mechanism/boot and the engaging surface 28 for a longer period of time before such compromise in the integrity eventually renders the cleaning head unusable.

Accordingly, the gripping mechanism 25 of the present invention is adapted to cooperate with the inwardly facing engaging surface 28 of the cleaning head 21. As mentioned, the contact region 27 of the gripping mechanism 25 is radially displaceable between the release condition (FIGS. 5A and 5F), enabling insertion of the gripping mechanism into the gripping cavity, and the gripping condition (FIG. 5D), engaging the elastic boot between the contact region 27 and the engaging surface 28 to form the fluid-tight seal thereof.

Figure 3:
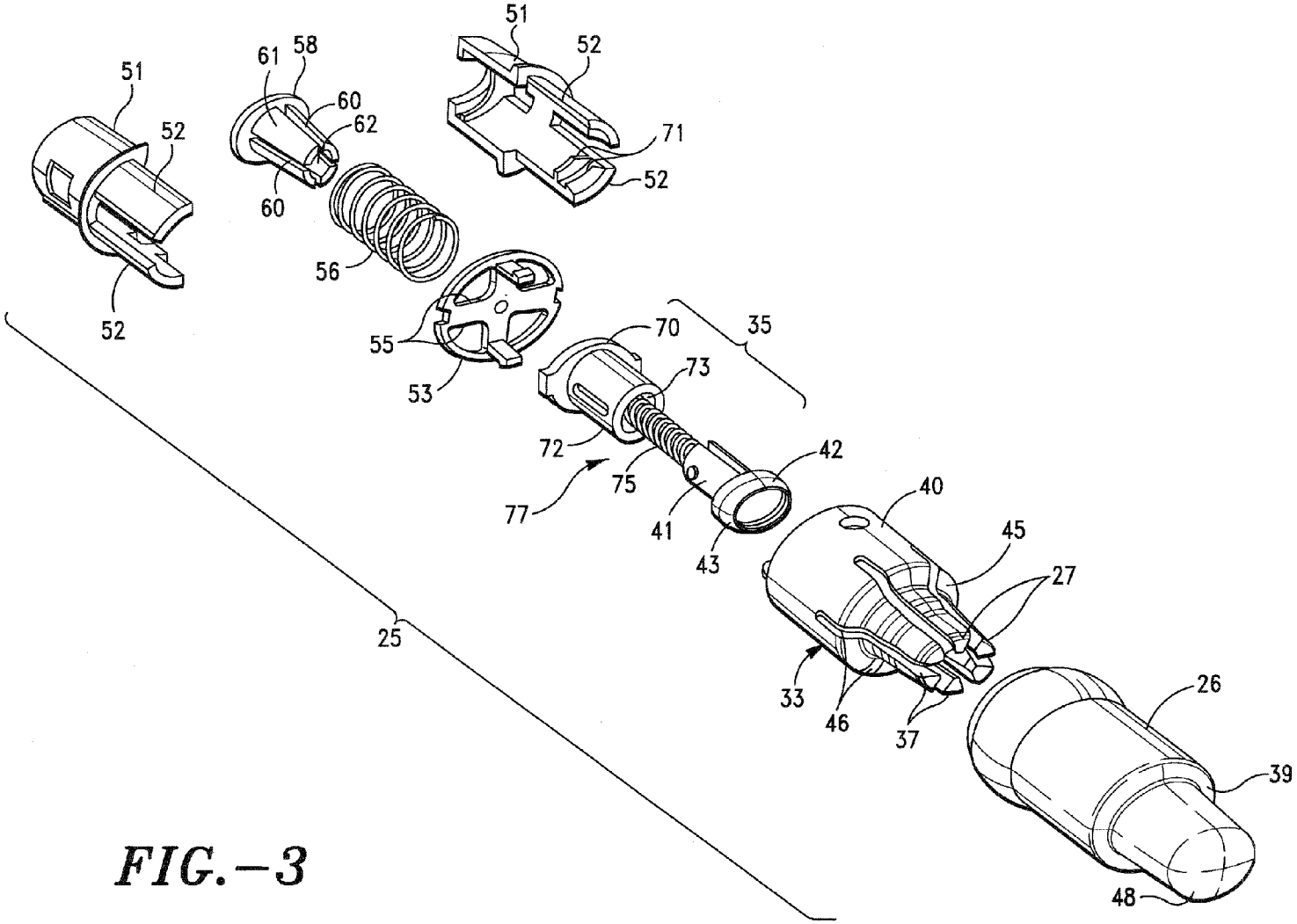
FIG. 3 is an enlarged, exploded, top perspective view of a gripping mechanism of the cleaning tool assembly of FIG. 1.

Referring now to FIGS. 3 and 5, the gripping mechanism 25 includes a radially expandable collet device 33 that cooperates with a plunger mechanism 35 to outwardly displace the exterior facing contact region 27 of the collet device from the release condition to the gripping condition. The liquid impervious elastic boot 26 is essentially a thin hollow shell member having a gripping mechanism opening 36 on one end thereof which is configured for receipt of the collet device and plunger mechanism therein. As will be described below, this shell member is generally sized and dimensioned, including a boot nipple portion 48 and a surrounding collar portion 39, substantially similar to the exterior peripheral surface of the collet device 33 in the release condition.

In one specific embodiment, the collet device 33 includes a plurality of finger members 37 containing respective exterior facing contact regions 27 that are displaceable radially outward from a longitudinal axis 38 of the gripping mechanism 25 between the release condition (FIGS. 5A and 5F) and the gripping condition (FIG. 5D). The finger members 37 are cantilever mounted to a hollow base portion 40 of the collet device 33 enabling the distal tip portion of each finger member 37 to pivot generally radially outward. Briefly, as a plunger rod 41, having a distal plunger head 42, of the plunger mechanism 35 reciprocates along a longitudinal axis of the gripping mechanism 25 from a disengaged condition (FIGS. 5A and 5F) to an engaged condition (FIGS. 5B–5E), a cam surface 43 of the plunger head 42 slideably contacts a respective interior facing backside displacement surface 44 of each finger member 37. Such simultaneous sliding contact between the plunger head 42 and the finger members 37 cantilever displace the respective contact regions 27 thereof radially outward toward the inwardly facing engaging surface 28 of the cleaning implement, from the release condition to the gripping condition.

Accordingly, the shell or hollow collet device 33 is composed of a flexible, yet resilient material, such that when the finger members are urged radially outward into contact with the elastic boot 26, upon release thereof, the finger members are biased back toward the natural, unstrained, release condition. Such suitable materials for the collet device 33 include plastic polymers, for example, polyethylene, nylon, ABS, NOREL™, etc, with optional low friction additives including TEFLON®.

In one specific configuration, the collet device 33 includes six independent finger members 37 cantilever mounted to the base portion 40, via respective shoulder portions 45 thereof. As best viewed in FIGS. 3 and 5, additional slotting 46 is provided between each finger member 37 and the respective shoulder portions 45 which extends into the base portion 40 of the collet device 33. While this arrangement effectively extends the length of the finger members 37 to facilitate further flexibility, the reduced material thickness at the respective proximal portions of the finger members promote cantilever bending at this juncture during movement between the release condition and the gripping condition. Essentially, a substantial portion of the pivotal motion occurs in this area.

It will be appreciated, of course, that the number of independent finger members 37 can be increased or decreased without departing from the true spirit and nature of the present invention. Collectively, each finger member 37 is circumferentially spaced about the longitudinal axis 38 to completely surround the plunger head 42 as it axially reciprocates. As mentioned, as the plunger head 42 moves distally along the direction of the gripping mechanism 25, relative the collet device 33, the cam surface thereof contacts a backside displacement surface 44 of each finger member 37. This movement generally urges the contact regions of the finger members radially outward to engage the elastic boot against the cavity engaging surfaces 28. Since each the finger member 37 gradually increases in material thickness (FIG. 5) from the respective proximal end to the respective distal end thereof, the radial displacement of the contact regions is gradually increased by moving the plunger head increasing forward toward the fully engaged condition. Consequently, the gripping force between the finger members 37 and the engaging surface 28 of the cleaning head is proportionately increased as well.

In one specific configuration, the gradual increase in the gripping force substantially linear and uniform. It will be appreciated, however, that a more complex force relationship can be established as well. For example, the curvilinear cam surface and the slope of the backside surface of the finger members can be arranged to a linear, decreasing, increasing, or variable slope.

Referring back to FIGS. 3, 5 and 6, each finger member 37 provides a respective outward facing surface that collectively define the displaceable contact regions 27 that apply the gripping force against the elastic boot 26 when moved to the gripping condition. The transverse cross-sectional area of the collective contact region 27 of the collet device 33, in the normal release condition (FIG. 5A), is sized and dimensioned substantially similar, but slightly circumferentially smaller than, that of the gripping cavity opening 31 and engaging surfaces 28. This form and dimension enables sliding insertion and/or removal of the elastic boot and collet device 33 into and from the gripping cavity 32, when the gripping mechanism is placed in the release condition.

Moreover, the non-circular, yet curvilinear dimension of the cavity opening 31 (FIG. 6) and corresponding engaging surfaces facilitate easy identification by the user to align and orient the collet device 33 with the opening 31 of the gripping cavity prior to insertion thereof. When the cleaning implement is mounted to the gripping mechanism is in the gripping condition, this non-circular arrangement further functions to reduce rotation or turning of implement about the tool assembly 20. Accordingly, the finger members 37 of the collet device 33 can be primarily designed and applied to singularly address the gripping function of the cleaning implement 21, and not the function of preventing rotation of the cleaning implement about the longitudinal axis of the gripping mechanism.

Figure 6:
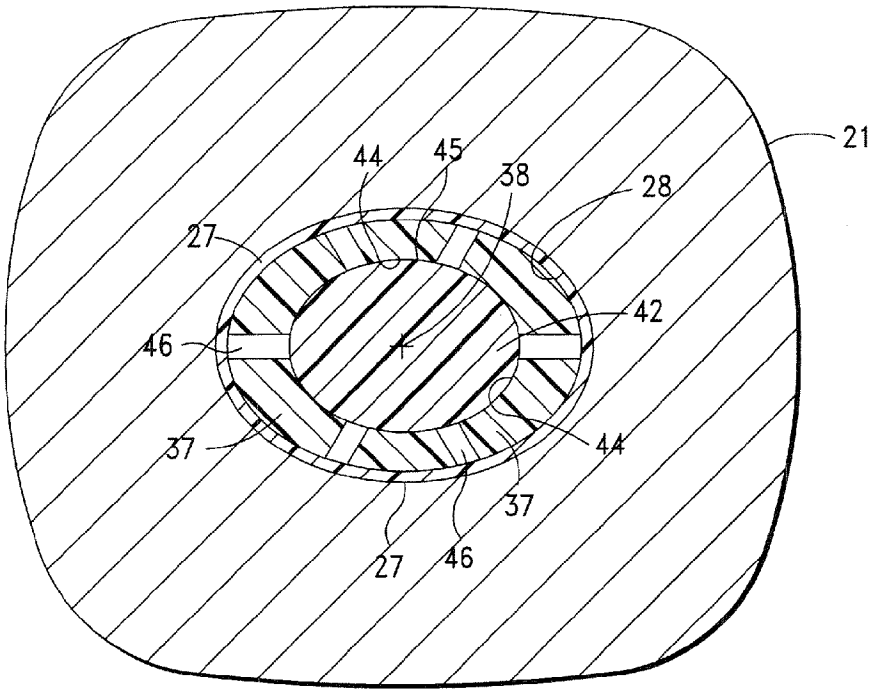
FIG. 6 is an enlarged, front elevation view, in cross-section, of the gripping mechanism taken substantially along the plane of the line 6—6 of FIG. 5D mounted to the cleaning implement.

Briefly, in one specific embodiment, the transverse cross-sectional peripheral dimension of the gripping cavity opening 31 and the collective contact region 27 of the collet device 33 is oval or elliptical-shaped (FIG. 6). This shape is beneficial for several reasons in addition to the reasons set forth above. For example, it has been found advantageous for the exterior cleaning surface of the cleaning implement to be non-spherical since, initially, any cleaning contact between the cleaning surface and a surface designated for cleaning would be only a point contact. By providing a multifaceted, yet still curvilinear cleaning surface, with flatter cleaning surfaces, such as the oval-shaped cleaning implement 21 shown in FIG. 6 would provide, a more universal cleaning implement is attained. This is especially advantageous when cleaning objects such as a toilet bowl.

In an effort to promote uniform wear distribution of the cleaning implement 21 during use and dissolution, it is desirable to provide a generally uniform thickness between the engaging surfaces 28 and back wall of the cleaning implement to the corresponding outer peripheral surfaces thereof. This is primarily performed by sizing, shaping and orienting the opening 31 and engaging surfaces 28 defining the gripping cavity 32 similar to the outer periphery surface of the cleaning head. As best viewed in FIG. 6, this geometric arrangement provides a generally uniform thickness of the cleaning implement around the finger members of the collet device 33. Moreover, due to the frangible nature of this compressed composite cleaning implement, the susceptibility to fracture by tension through the internal engaging surfaces is substantially greater than that by compression forces acting against the outer peripheral surfaces. Thus, a more gentle, curvilinear cavity opening/engaging surface combination reduces potential stress fracture regions which may occur in an opening shape featuring one or more angular stress points.

As above-mentioned, the proximal portion of each finger member 37 of the collet device 33 integrates with the base portion 40 through a respective shoulder portion 45. Each respective shoulder portion extends radially outward from the gripping mechanism longitudinal axis 38 (FIGS. 3, 5 and 6). Collectively, the shoulder portions 45 of the finger members extend beyond the opening 31 into the gripping cavity 32 so that when the finger members 37 are inserted into the gripping cavity, in the release condition, the respective shoulder portions 45 of the finger members 37 and the peripheral shoulder portion 45 of the elastic boot 26 can seat against the support surface of the cleaning head. This enables sealing of a portion of the boot against the intersecting edge between the engaging surface 28 and the support surface 30 at the cavity opening 31 when the gripping mechanism is moved to the gripping condition.

Briefly, as indicated above, the liquid impervious elastic boot 26 is essentially a thin hollow shell member having a gripping mechanism opening 36 on one end thereof which is configured for receipt of the collet device 33 and plunger mechanism 35 therein. The thin interior wall of the elastic boot essentially conforms to the exterior peripheral surface of the collet device 33 in the release condition. As the collet device 33 is inserted through the gripping mechanism opening 36 into the elastic boot, the finger members 37 of the collet extend into a corresponding nipple portion 48 of the boot until the shoulder portions 45 of the collet device engage the corresponding collar portion 39 of the boot. The proximal end of the elastic boot 26, defining the gripping mechanism opening 36 is mounted to the elongated shaft device in a fluid-tight manner using conventional adhesives. This completely encloses the gripping mechanism therein, and prevents fluid contact during operational liquid immersion unless the seal integrity is compromised.

The elastic boot can be composed of any flexible, liquid impervious material. This elasticity is necessary as the finger members 37 displace between the release condition and the gripping condition to maintain a relatively taut surface. Such materials include rubber and various synthetic elastomers, such as Krayton™.

Figure 5B:
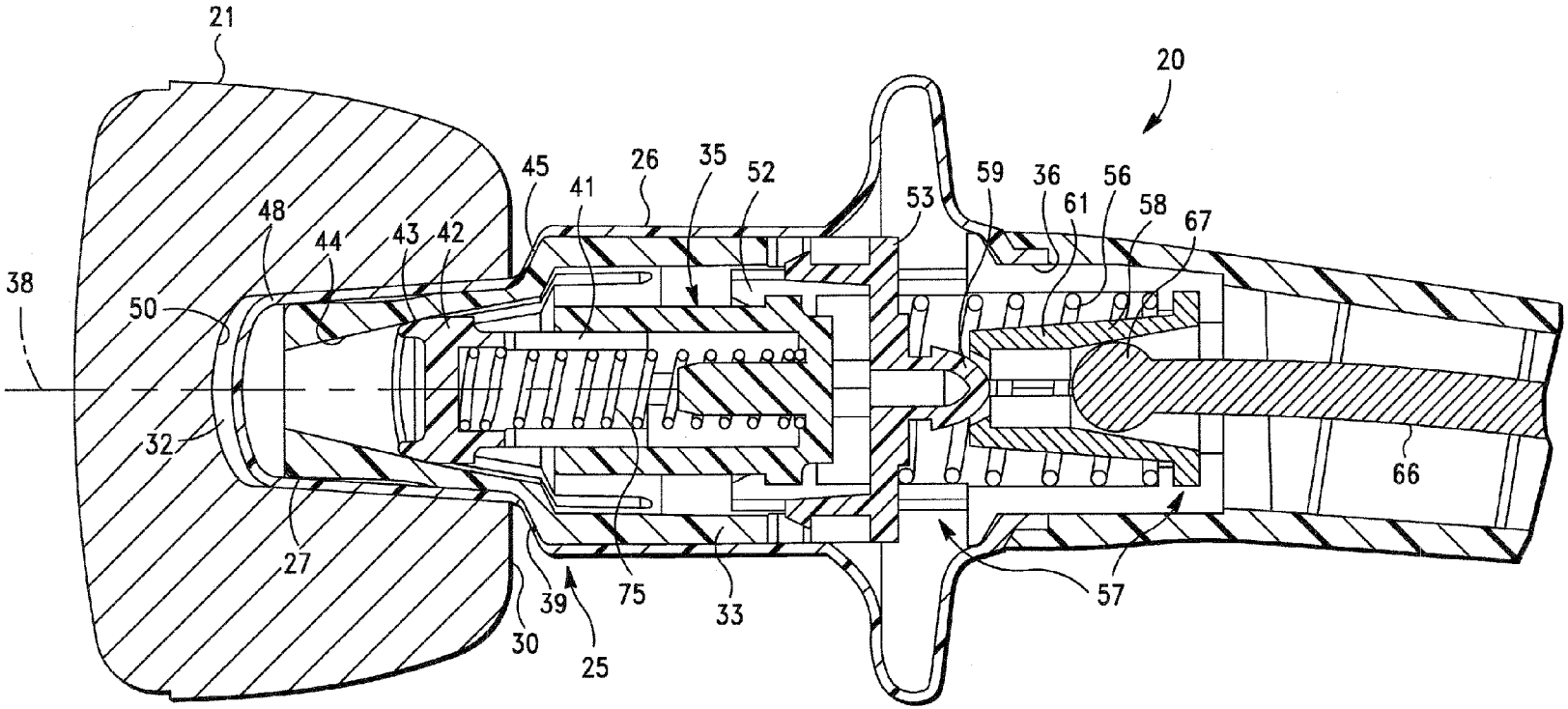

Turning now to FIG. 5B, the length of each finger member 37 (or the depth of the gripping cavity) is sized to extend into the gripping cavity without bottoming out against the back wall 50 that forms part of the gripping cavity 32. This assures that the shoulder portions of the fingers, and thus of the corresponding shoulder portion 45 of the elastic boot 26 will seat against the intersecting edge between the engaging surface 28 and the support surface 30 at the gripping cavity opening 31 of the cleaning implement 21. Further, in a normal, relaxed state, the finger members 37 are oriented in the release condition so that they extend generally in the direction of the longitudinal axis 38 of the gripping mechanism 25. Thus, the exterior surface of the finger members, which for the most part constitute the contact regions 27, also extend generally parallel to the longitudinal axis, although tapered slightly inwardly at an angle of about 1° to about 40° from the longitudinal axis, to permit sliding receipt of the collet device/boot into or out of the gripping cavity 32.

Briefly, as will be described in greater detail below, when the plunger head 42 is moved axially relative the finger members 37 to the engaged condition, the cam surface 43 engages the backside displacement surface 44 of the finger members to gradually push them radially outward from the gripping mechanism longitudinal axis 38. Hence, the cantilever mounted finger members 37 bend at their respective proximal portions, and are no longer oriented in their relaxed state relative the longitudinal axis 38. This of course generates the gripping forces necessary to retain the cleaning implement and create the liquid seal where the boot contacts the cleaning head. Once the plunger head 42 is retracted out of engaging contact with the backside displacement surface of the finger members 37, the resiliency and bias of the collet device drawing the respective contact regions 27 of the finger members out of engagement against the engaging surfaces 28 to enable removal of the gripping mechanism from the gripping cavity 32.

As best viewed in FIGS. 5A–5E, the plunger head 42 of the plunger mechanism 35 is adapted to move, relative the collet device 33, axially along the gripping mechanism longitudinal axis 38 between a disengaged condition (FIG. 5A), corresponding to the release condition of the respective finger member contact regions 27, and an engaged condition (FIGS. 5B–5E), corresponding to the gripping condition of the respective finger member contact regions 27. In the one specific embodiment illustrated, however, it is the collet device 33 itself that actually slides relative the shaft 22 between the disengaged condition and the engaged condition. This embodiment, will now be described in greater detail.

To mount the sliding collet device 33 to the elongated shaft 22, a coupler device 51 is rigidly positioned at a distal end of the shaft 22. The coupler device 51 includes a plurality of prongs 52 extending generally axially in the direction of the longitudinal axis 38 of the gripping mechanism 25. These prongs 52 slideably engage a retainer plate 53 of the collet device 33, which in turn is mounted to the bottom of the hollow elliptical base portion 40. The retainer plate 53 provides a plurality of alignment passages 55 (FIG. 3), each formed and dimensioned for sliding receipt of a corresponding prong 52 therethrough. As the collet device 33 is axially displaced toward the shaft, which incidentally corresponds to movement of the plunger head 42 of the plunger mechanism 35 toward the engaged condition, the prongs 52 slide through the corresponding alignment passages and into the hollow base portion of the collet device 33. Thus, the aligned sliding engagement between the alignment passages 55 and the prongs 52 enables aligned axial reciprocation of the collet device 33 between the disengaged condition and the engaged condition.

A collet biasing device 56 biases the collet device 33 toward the disengaged condition which in effect biases the gripping mechanism 25 toward the gripping condition. This biasing device 56 is preferably provided by a coiled compression spring disposed in the hollow between the prongs 52 of the coupler device 51. One end of the collet spring 56 abuts against the coupler device 51 while an opposite end thereof abuts against the backside of the retainer plate 53 of the collet device 33. Thus, when the collet device 33 is slideably urged along the prongs 52 toward the engaged condition, the spring 56 is compressed between the coupler device 51 and the retainer plate 53. Consequently, as the finger members 37 are caused to slide along the cam surface 43 of the plunger head toward the extended condition, the respective contact regions 27 thereof are displaced radially outward toward the engaging surfaces 28 of the cleaning implement gripping cavity 32.

Figure 5C:
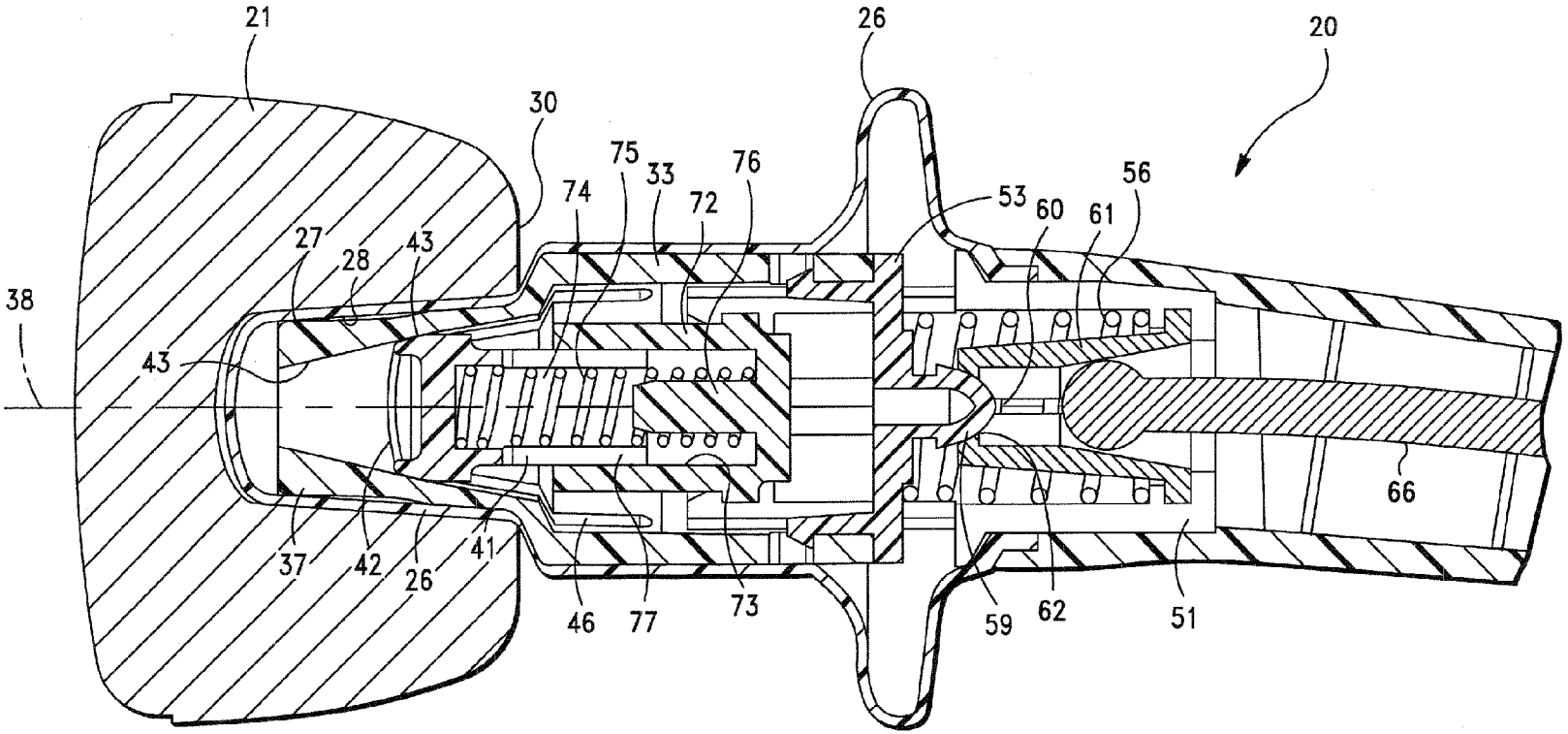
Figure 5D:
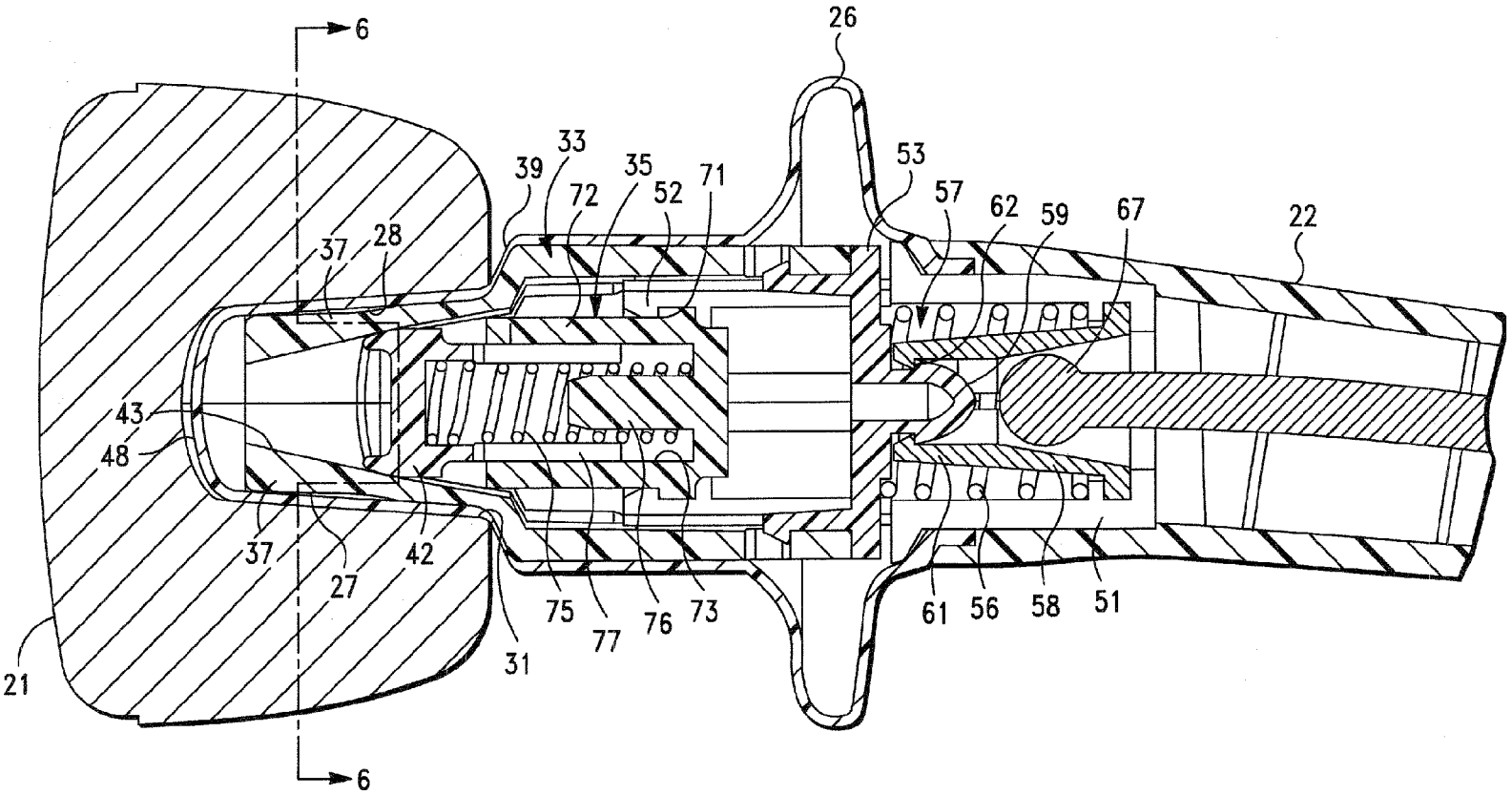

FIG. 5B–5D best illustrate that sliding movement of the collet device 33 along the prongs 52 continue until a latch mechanism 57 is engaged, retaining the collet device 33 in the engaged condition and the gripping mechanism 25 in the gripping condition. This movement, of course, is in opposition to the force generated by the collet spring 56 that biases the collet device 33 toward the disengaged condition. The latch mechanism 57 includes a nipple portion 59 protruding proximally from the backside of the collet retainer plate 53. A latch base 58 is disposed at the bottom of the hollow of the coupler device 51. Both the retainer nipple portion 59 and the latch base 58 are disposed in the interior of the collet coil spring 56 so that structural interference can be prevented during reciprocal movement. Further, both are aligned axially and oriented for engagement therebetween when the collet device 33 is moved fully to the engaged condition.

In particular, the latch base 58 is provided by a hollow conical shaped shell having a plurality of axially extending slots 60 that form a plurality of cantilevered legs 61. The distal portions of the legs 61 include a respective ledge portion 62 that collectively form a receiving aperture which snap-fit engages a head of the retainer nipple portion 59. During movement of the collet device toward the extended condition, a cam surface of the head of the nipple portion 59 contacts the respective ledge portions of the latch base legs 61, radially spreading them apart (FIG. 5C). Continued axial movement together contact of the nipple head against the slotted latch base causes continued radial displacement of the ledge portions 62 until they can accommodate passage of the head through the aperture. Once the head of the nipple portion 59 passes through the aperture, the resiliency of the legs 61 cause the respective ledge portions 62 to engage a neck of the nipple portion under the head (FIG. 5D). This leg resiliency is sufficient to overcome the bias of the collet spring so as to latch the collet device in the engaged condition.

Figure 4:
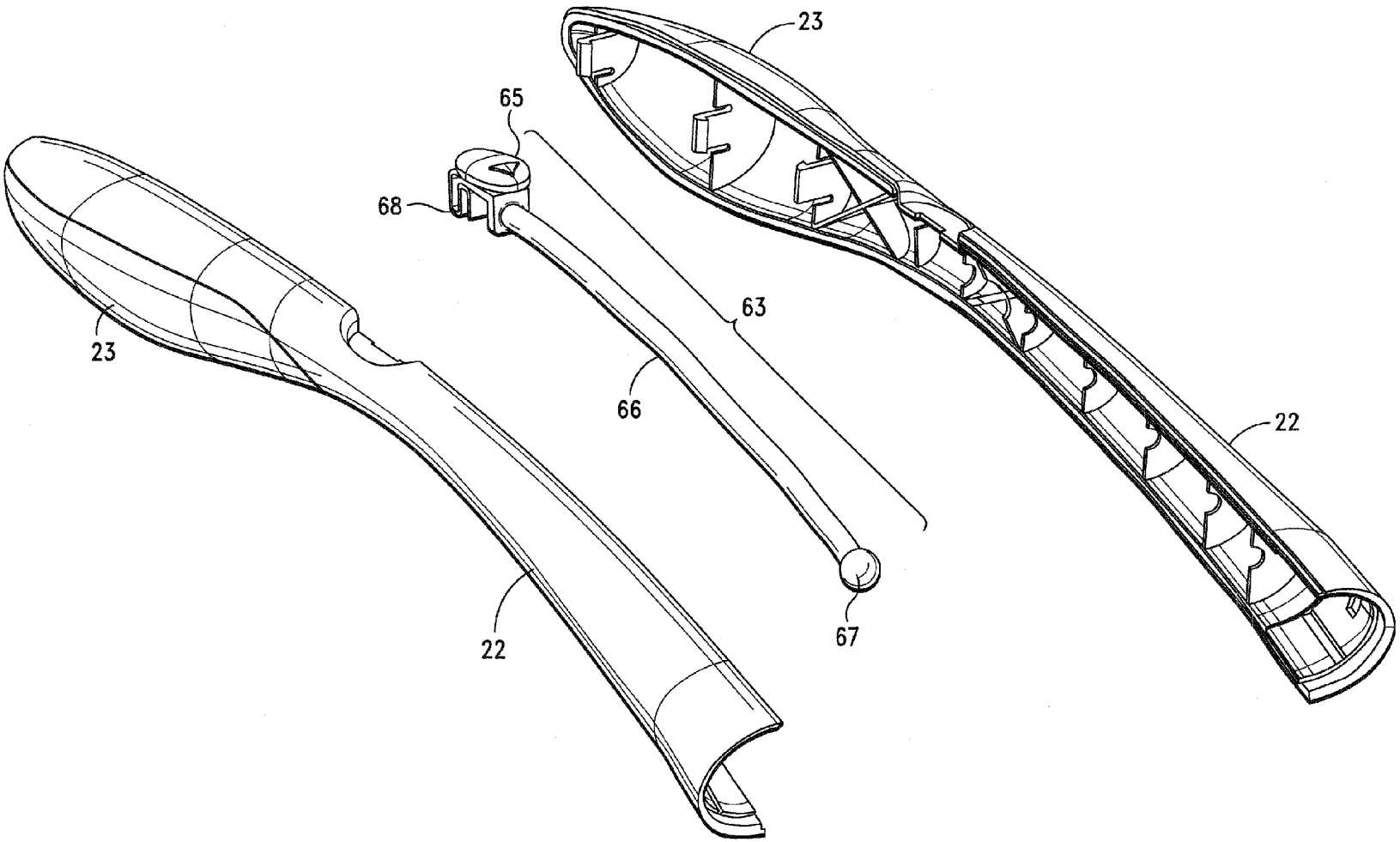
FIG. 4 is an enlarged, exploded, top perspective view of a handle and shaft portion of the cleaning tool assembly of FIG. 1.

To release the latch mechanism 57, a release device 63 (FIGS. 2 and 4) is provided at the handle portion 23 of the elongated shaft. This release device 63 includes a spring biased switch 65 that actuates the latch mechanism 57 to release of the locked collet device 33 from the engaged condition. Upon release, the collet spring 56 urges the collet device 33 toward the disengaged condition, and thus, the gripping mechanism from the gripping condition to the release condition, releasing the cleaning implement from the tool assembly 20.

The switch 65 is coupled to pushrod 66 having a spherical contact 67 at the distal end thereof. The release device 63 is movable between a normal position (FIGS. 5A–5E), where the spherical contact 67 does not sufficiently contact with the latch base 58 to release the nipple portion 59, and a release position, where the spherical contact 67 sufficiently contacts the hollow latch base 58 to commence release the nipple portion 59. As the pushrod spherical contact 67 slideably contacts the interior walls of the legs 61 of the hollow, slotted latch base 58 (FIG. 5E), the distal portions of the legs are caused to spread radially apart. Consequently, the aperture diameter is radially increased or widened until the ledge portions 62 of the legs release the head of the retainer nipple portion 59. The collet spring 56 subsequently urges the collet device 33 toward the disengaged condition that withdraws the plunger head from contact with the finger members 37.

A leaf spring 68 (FIG. 2) is coupled to the switch 65, and biases the release device 63 toward the normal position. Accordingly, when it is desirable to eject and discard the cleaning implement, the user operates the switch 65 from the handle portion 23, manually sliding it from the normal position toward the release position. Upon release of the switch device, the leaf spring 68 urges the pushrod back toward the normal position.

Figure 5E:
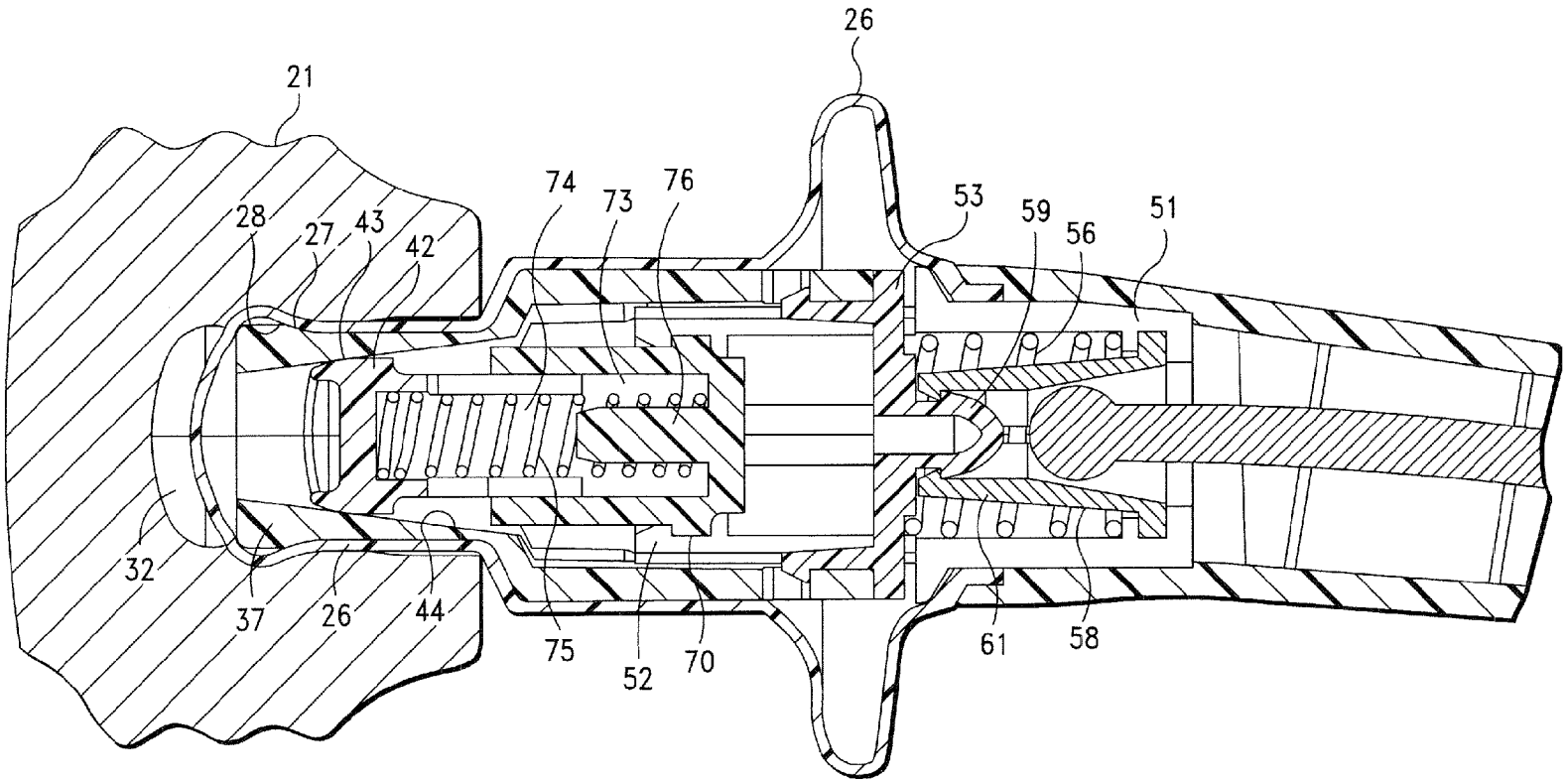
Figure 5F:
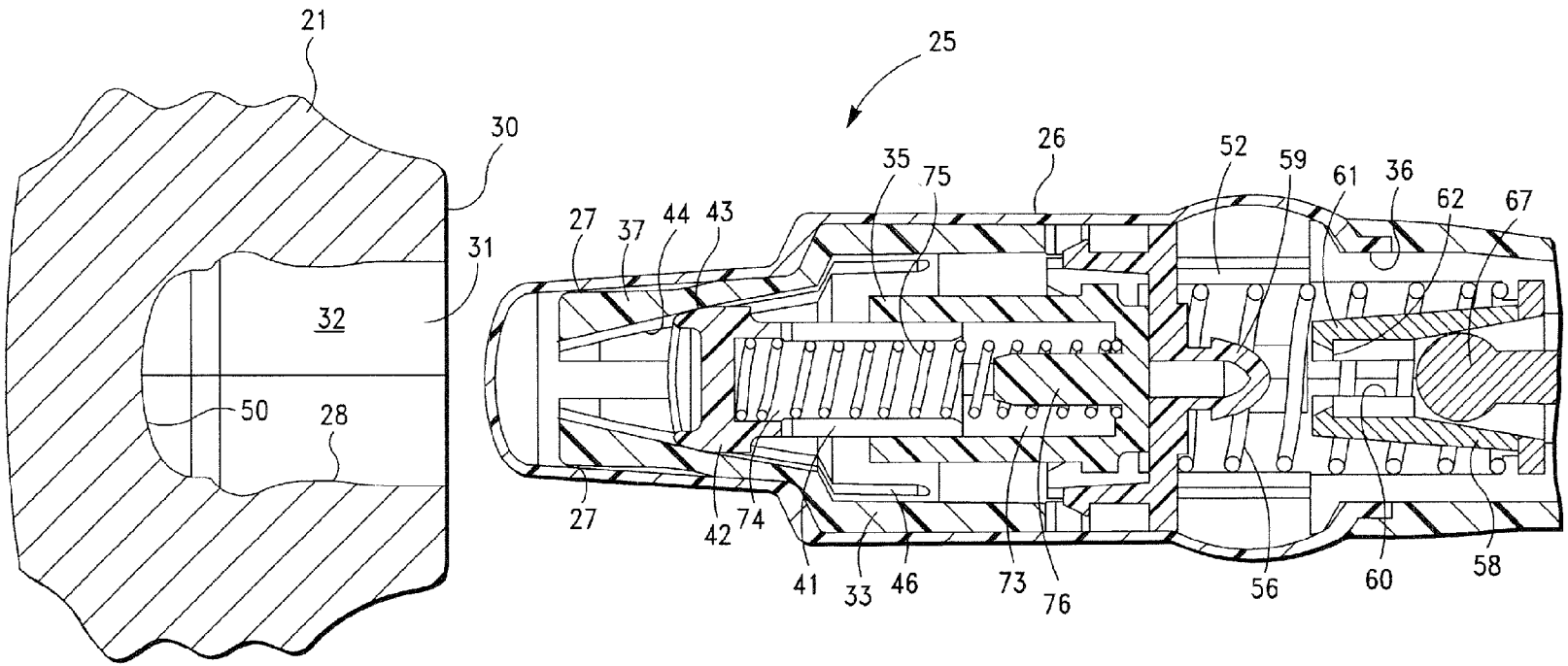

Referring now to FIG. 5F, as the collet spring 56 urges the collet device 33 toward the disengaged condition, the travel thereof along the prongs 52 is limited by a plunger back 70 of the plunger mechanism 35. In particular, each prong 52 includes a pair (proximal and distal) of securing tangs 71 at a respective distal tip portion thereof which are adapted to engage and retain the plunger back 70 of the plunger mechanism 35 therebetween. It is the plunger back 70 that functions as a stop device to limit the travel of the collet device at the disengaged condition.

The distal portion of the plunger back 70 provides a cylindrical-shaped base 72 that includes a recess 73 formed and dimensioned for reciprocating receipt of the plunger rod 41 therein. Such sliding receipt of the plunger rod 41 in the recess enables the plunger head 42 independent and limited sliding reciprocation along the backside displacement surface 44 of the finger members 37 and along the elongated shaft 22 between a retracted position (FIG. 5D) and an extended position (FIGS. 5A and 5F). This axial movement is in addition to the sliding reciprocation of the collet device relative the elongated shaft 22 between the disengaged condition and the engaged condition. A plunger biasing device 75 is disposed in the recess 73 between the plunger rod 41 and the plunger back 70 that biases the plunger head 42 toward the extended position.

This plunger biasing device 75 is preferably provided by a coiled compression spring having one end extending around an alignment pin 76 positioned at the bottom of the recess of the plunger back 70. The other end of the compression spring abuts against a back surface in a hollow 74 of the plunger rod 41. Collectively, these plunger components cooperate with the finger members 37 of the collet device 33 to form a force limiting mechanism 77 that limits the amount of radial gripping force that the finger members 37 (i.e., the collet device 33) can radially apply to the engaging surfaces 28 of the cleaning implement 21. Consequently, by limiting such outward radial gripping forces so as not surpass a predetermined threshold limit, inadvertent fracture of these frangible composite cleaning heads can be significantly avoided or reduced.

Essentially, the contact between the backside displacement surface 44 of the finger members 37 and the cam surface 43 of the plunger head 42 function to translate the collective radial gripping force between the contact regions 27 and the engaging surfaces linearly to the plunger (compression) spring 75. Accordingly, as the expansion of the finger members 37 is physically limited by the engaging surfaces 28 of the cleaning implement, the axial travel of the plunger head 42 along the backside displacement surface of the finger member 37 is consequently limited. At this physical expansion limitation, any additional axial movement of the collet device 33 toward the extended condition, together with the limited travel of the plunger head 42 relative the finger members 37, causes the plunger spring 75 to compress. Accordingly, as viewed in FIGS. 5A–5D, the plunger rod 41 is axially displaced and retracts into the base recess 73 from the extended condition to the retracted condition. In turn, the force generated by the finger members upon the engaging surfaces is also limited to a predetermined threshold. In one specific embodiment, the radial force translates into a threshold compression spring force in the range of about 1 lbf to about 15 lbf.

Referring back to FIG. 5A, during the mounting operation of the cleaning implement 21 to the cleaning tool assembly 20, the gripping mechanism 25 must first be positioned in the release condition. The gripping mechanism 25, with the elastic boot cover, is then aligned and oriented relative the opening 31 into the gripping cavity 32 of the cleaning implement 21. As mentioned, the cavity opening 31 of the cleaning implement 21, and the transverse cross-sectional dimension of the contact region 27 of the collet device 33 are similarly sized and elliptical-shaped when the gripping mechanism is positioned in the release condition. This enables the collet device 33 of the gripping mechanism 25 and mounted elastic boot 26 of the cleaning tool assembly 20 to be easily, visually aligned with the cavity opening 31.

The finger members/elastic boot of the gripping mechanism 25 are inserted into the gripping cavity 32 until the respective shoulder portions 45 of the respective finger members 37 seat and sandwich the elastic boot against the edge intersection and the support surface 30 of the cleaning head. Continued manual insertion into the gripping cavity, using the handle portion 23 of the elongated shaft against the cleaning head support surface 30 cause the collet device 33 to move axially along the prongs 52 of the coupler device 51. This applied insertion force must be sufficient to overcome the compression force of compression spring 56 abutting the backside of the retainer plate 53. As this occurs, the curvilinear-shaped cam surface 43 of the plunger head 42 slides axially along the backside displacement surface 44 of the finger members (FIGS. 5A to 5D).

As previously mentioned, the radial gripping force applied by the finger members is gradually increased as the plunger mechanism 35 is moved axially along the longitudinal axis of the gripping mechanism 25. This is due in-part to the cantilever mounting nature of the finger members 37, and the gradual increase in the thickness of each finger member from the proximal end to the distal end thereof. When the contact regions 27 of the finger members 37 are displaced radially outward, upon contact with the cavity engaging surfaces 28, the fingers will be physically restrained by contact with of the cleaning implement. That is, since the walls of the cleaning implement engaging surface 28 are preferably relatively rigid, and are substantially similar in size and dimension to the cavity opening 31 (i.e., the walls extend generally parallel to the longitudinal axis), the initial outward radial displacement of the finger contact regions 27 will be relatively small, and will be constrained quickly. The contact regions 27 of the finger members 37 will generally be nearly parallel to the gripping mechanism longitudinal axis 38 during initial gripping contact.

The slope of the respective backside displacement surface 44 of the respective finger member 37 together with the curvilinear cam surface of the cleaning head enable translation of collective radial gripping force to a collective axial component acting on the plunger compression spring. As mentioned, when the axial gripping force component surpasses the predetermined threshold force, the plunger spring 75 will be caused to compress toward the retracted condition (FIGS. 5B and 5C) which limits the axial displacement of the plunger mechanism 35 along the collet device. In turn, the radial displacement of the finger members 37 is limited which consequently limits the radial gripping force applied to the engaging surface of the cleaning implement. Both the plunger spring 75 and the collet spring continue compression along the longitudinal axis of the gripping mechanism until the nipple portion 59 interlocks with the latch base 58 in the gripping condition (FIG. 5D).

In this position, the finger members 37 of the collet device 33 abut elastic boot 26 against the engaging surfaces 28 of the cleaning implement 21. Further, the respective shoulder portions 45 of the finger members 37 collectively position the collar portion 39 of the elastic boot over the cavity opening 31 and against the engaging surfaces 28. A substantially liquid-tight seal is thus formed between the elastic boot and the respective relatively rigid portions of the cleaning implement 21 by the collet device 33. This seal substantially delays detrimental contact of any liquids with the engaging surface of the cleaning implement during liquid immersion and use thereof.

In due time, however, the seal integrity between the elastic boot 26 and the corresponding surfaces of the cleaning implement will be compromised. Due to the repetitious nature of operational use or dissolution of the implement surfaces, the fluids will eventually penetrate the seal and flow between the elastic boot 26 and the cleaning implement surfaces.

Once the cleaning implement engaging surfaces 28 dissolve and/or degrade, the gripping integrity of the gripping mechanism 25 to the cleaning implement will be maintained. As the engaging surfaces defining the gripping cavity 32 of the cleaning implement 21 begin to dissolve, the volumetric capacity and surface area of the engaging surfaces of the gripping cavity increase in dimension. The force limiting mechanism 77 compensates for this expansion which in effect increases the gripping mechanisms capacity to retain the cleaning implement 21 to the collet device 33.

As the interior engaging surfaces 28 of the cleaning implement wear and/or dissolve, the radial gripping forces opposing the respective finger members incrementally decrease. To compensate, the plunger spring 75 urges the plunger head 42, via the plunger rod 41, further axially along the backside displacement surface 44 of the finger members 37. FIG. 5E best illustrates that the respective contact regions 27 of the finger members 37 are displaced further radially outward to contact the opposed engaging surfaces 28 until the threshold gripping force is again attained.

In one specific embodiment of the present invention, however, not only will the gripping integrity of the gripping mechanism 25 to the cleaning implement be maintained, but in some instances it may be significantly improved. As the plunger head 42 is axially advanced toward the extended position along the finger members 37, the cam surface 43 of the plunger head 42 contact the respective backside displacement surfaces 44 of the finger members 37 more distally therealong. Thus, the radial gripping forces of the contact regions 27 of the finger members 37 are increasing translated more distally, as opposed to the proximal portions of the finger member contact regions. Consequently, the dissolution of the engaging surfaces 28 of the cleaning implement more conform to the peripheral form and dimension of the finger members 37. That is, as shown in FIG. 5E, the radial distance of respective the engaging surface 28 gradually increases from the cavity opening 31 to the back wall thereof. In effect, an undercut is generated where the radial diameter gradually increases deeper into the gripping cavity, more of less conforming to the collective peripheral shape of the contact regions 27 of the finger members 37. Accordingly, since the radial spread of distal tips of the finger members 37 has a greater diameter than that at the proximal portion thereof, inadvertent removal of the cleaning implement from the cleaning tool assembly 20 is significantly reduced.

In another specific configuration of the present invention, the respective contact regions 27 of the finger members 37 may include a plurality of space-apart gripping nubs or the like (not shown) which add gripping contact with the engaging surfaces of the cleaning implement. These nubs are sufficiently sized and dimensioned to translate through the elastic boot to facilitate gripping. Alternatively, the nubs could be formed into the surface of the elastic boot as well. In either arrangement, similar to the conformation of the engaging surface 28 to the finger members 37, the gripping force could eventually cause the nubs to form indentation into the engaging surfaces for addition gripping thereof.

Although only a few embodiments of the present inventions have been described in detail, it should be understood that the present inventions may be embodied in many other specific forms without departing from the spirit or scope of the inventions.

What is claimed is:

1. A cleaning tool assembly adapted to removably mount a disposable cleaning implement thereto, said cleaning implement having a liquid soluble or liquid dispersible, relatively rigid engaging surface, said tool assembly comprising:

an elongated shaft having a handle portion on one end thereof;

a gripping mechanism mounted to the elongated shaft, and including a contact region moveable between a gripping condition, wherein said contact region cooperates with said engaging surface of the cleaning implement to releasably mount the cleaning implement to the elongated shaft, and a release condition, wherein said cleaning implement is released from said gripping mechanism; and an elastic boot composed of a substantially liquid impervious material and configured to extend substantially over said contact region of the gripping mechanism such that when said gripping mechanism is in the gripping condition, said contact region urges said elastic boot against said engaging surface of said cleaning implement to form a substantially liquid-tight seal therebetween to substantially delay solubility or dispersion of said engaging surface during liquid immersion and use of the cleaning implement.

2. The cleaning tool assembly according to claim 1, wherein said gripping mechanism includes an expandable collet device providing said contact region, and adapted for expansion from the release condition to the gripping condition wherein said contact region of the collet device contacts a backside surface of the elastic boot to urge a topside surface thereof into gripping contact with the engaging surface of the cleaning implement from gripping thereof.

3. The cleaning tool assembly according to claim 2, wherein said contact region of said collet device is generally elliptical-shaped to substantially conform with the elliptical-shape of the opening and engaging surface defining a gripping cavity of the cleaning implement such that upon radial expansion of the collet device in said gripping cavity to the gripping condition, said boot being expanded radially outward into gripping contact with the engaging surface for gripping and formation of said liquid tight seal therewith.

4. The cleaning tool assembly according to claim 3, wherein said collet device of said gripping mechanism is adapted to radially contact the boot backside surface, in said gripping condition, in a manner exerting substantially uniform pressure radially outward on said engaging surface.

5. The cleaning tool assembly according to claim 3, wherein said collet device of said gripping mechanism includes a plurality of finger members extending distally from said elongated shaft, and positioned generally radially around a longitudinal axis of the collet device, the outer contact region of each said finger member collectively having a transverse cross-sectional dimension substantially conforming to elliptical shape of the cavity opening, when in the release condition, said finger members being formed and dimensioned to collectively, slideably insert into the gripping cavity of the cleaning implement when said gripping mechanism is situated in the release condition.

6. The cleaning tool assembly according to claim 5, wherein said gripping mechanism further includes a plunger mechanism having a plunger head disposed for relative reciprocating movement along the longitudinal axis of the collet device between a disengaged condition and an engaged condition wherein a cam surface of the plunger head contacts an opposed underside displacement surface of the finger member causing the respective contacting regions thereof to move radially outward from the release condition toward the gripping condition.

7. The cleaning tool assembly according to claim 6, further including:

a force limiting device cooperating with said plunger mechanism to limit the force applied by the plunger head to said finger members and the cleaning implement engaging surface.

8. The cleaning tool assembly according to claim 7, wherein said plunger mechanism is adapted for movement relative said shaft along the collet longitudinal axis between an extended condition, extending the plunger head away from said shaft, and a retracted condition, and said force limiting device includes a plunger biasing device biasing said plunger mechanism toward the extended condition.

9. The cleaning tool assembly according to claim 1, further including:

a force limiting device cooperating with the gripping mechanism to limit the engaging force applied to the engaging surface of the cleaning implement by the collet contact region.

10. A gripping tool adapted to removably secure a disposable, liquid soluble or liquid dispersible cleaning head thereto, said cleaning head including a support surface defining an elliptical-shaped opening into a gripping cavity thereof, said gripping cavity further being defined by a back wall and a relatively rigid side engaging surface extending between the support surface and the back wall, said gripping tool comprising:

an elongated shaft having a handle portion on one end thereof;

a relatively thin, elastic boot composed of a substantially liquid impervious material and having a nipple portion sized and dimensioned for sliding receipt through said opening and into the gripping cavity of said cleaning head, said boot further including a peripheral collar portion extending radially outward from a base of the nipple portion and beyond the cavity opening when said nipple portion is placed in said gripping cavity; and a gripping mechanism mounted to the elongated shaft, and including a distally extending collet device and shoulder portion positioned at the base of the collet device, said collet device and said shoulder portion being sized and dimensioned for positioning into nipple portion and collar portion, respectively, of the boot until said shoulder portion is positioned proximal to an underside surface of the boot collar portion, said collet device being selectively movable between a release condition, enabling insertion of the boot nipple portion into the head gripping cavity until the boot collar portion extends over the cavity opening and seats against the head support surface, and a gripping condition, wherein a peripheral contact region of the collet device is positioned radially outward from a longitudinal axis thereof causing the boot nipple portion to contact the opposed cavity engaging surface to releasably mount the cleaning head to the elongated shaft and form a substantially liquid-tight seal therebetween to substantially delay solubility or dispersion of said engaging surface during liquid immersion and use of the cleaning head.

11. The gripping tool according to claim 10, wherein said collet device of said gripping mechanism is adapted to radially contact a backside surface of the boot, in said gripping condition, in a manner exerting substantially uniform pressure radially outward on the head engaging surface.

12. The gripping tool according to claim 11, wherein said collet device of said gripping mechanism includes a plurality of finger members extending distally from said shaft, and positioned generally radially around the longitudinal axis of the collet device, the outer contact region of each said finger member collectively having a transverse cross-sectional dimension substantially conforming to the elliptical shape of the cavity opening, when in the release condition.

13. The gripping tool according to claim 12, wherein said gripping mechanism further includes a plunger mechanism having a plunger head disposed for relative reciprocating movement along the longitudinal axis of the collet device between a disengaged condition and an engaged condition wherein a cam surface of the plunger head contacts an opposed underside displacement surface of the finger member causing the respective contacting regions thereof to move radially outward from the release condition toward the gripping condition.

14. The gripping tool according to claim 13, wherein said collet device further includes a base portion, and each finger member is cantilever mounted to the base portion at a respective proximal location thereof for radial cantilever movement between the release condition and the gripping condition as the plunger head is axially displaced between the disengaged condition and the engaged condition.

15. The gripping tool according to claim 14, wherein each said finger member cooperates with the cam surface of the plunger head to displace the respective contact region of the finger member increasingly radially outward during relative movement as the plunger head is displaced axially along the longitudinal axis of the collet device toward the engaged condition.

16. The gripping tool according to claim 15, wherein the respective height of each finger member increases in thickness dimension from the proximal end to the distal end thereof to cause increasing gripping pressure between the collet device and the cleaning head as the plunger mechanism moves from the disengaged condition to the engaged condition.

17. The gripping tool according to claim 16, wherein said gripping mechanism includes a biasing device to bias the gripping mechanism toward the release condition.

18. The gripping tool according to claim 17, wherein said biasing device includes a compression spring.

19. The gripping tool according to claim 17, wherein said collet device is slideably mounted to said elongated shaft of the gripping tool, and the biasing device to urge the collet device toward the released condition.

20. The gripping tool according to claim 19, further including:

a force limiting device cooperating with said plunger mechanism to limit the force applied by the plunger head to said finger members and the head engaging surface.

21. The gripping tool according to claim 20, wherein said plunger mechanism is adapted for movement relative said shaft along the collet longitudinal axis between an extended condition, extending the plunger head away from said shaft, and a retracted condition, and said force limiting device includes a plunger biasing device biasing said plunger mechanism toward the extended condition.

22. The gripping tool according to claim 21, wherein said plunger mechanism is slideably mounted to a bracket of the shaft for axial movement between the retracted condition and the extended condition, and said plunger biasing device includes a compression spring positioned between the plunger mechanism and the bracket to bias the plunger head toward the extended condition.

23. The gripping tool according to claim 17, further including:

a latch mechanism cooperating with the plunger mechanism and collet device to lock the gripping mechanism in the gripping condition.

24. The gripping tool according to claim 23, further including:

a release mechanism cooperating with the latch mechanism and the biasing device to release the gripping mechanism from the gripping condition.

25. The cleaning tool assembly according to claim 13, further including:

a release mechanism cooperating with the latch mechanism and the biasing device to release the gripping mechanism from the gripping condition.

26. A maneuvering tool adapted to removably secure a disposable, liquid soluble or liquid dispersible cleaning head thereto, said cleaning head including a support surface defining an elliptical-shaped opening into a gripping cavity thereof, said gripping cavity further being defined by a back wall and a relatively rigid, inwardly facing, side engaging surface extending between the support surface and the back wall, said maneuvering tool comprising:

an elongated shaft having a handle portion on one end thereof;

an internal gripping mechanism mounted to the elongated shaft and including a collet device having an expansive, circumferential, outward facing contact region sized and dimensioned for sliding insertion through the elliptical-shaped opening and into the gripping cavity when oriented in a release condition, said gripping mechanism selectively movable between the release condition and a gripping condition wherein the outward facing contact region is displaced radially outward from a longitudinal axis of The collect device and into gripping cooperation with the inwardly facing, side engaging surface to provide a substantially uniform engaging force therebetween for mounting of the cleaning head during operation;

a force limiting device cooperating with the gripping mechanism to limit the uniform engaging force applied to the side engaging surface of the cleaning head by the collet contact region, and;

an elastic boot composed of a substantially liquid impervious material and configured to extend substantially over said contact region of the gripping mechanism such that when said gripping mechanism is in the gripping condition, said contact region urges said elastic boot against said engaging surface of said cleaning implement to form a substantially liquid-tight seal therebetween to substantially delay solubility of said engaging surface during liquid immersion and use of the cleaning head.

27. The maneuvering tool according to claim 26, wherein said collet device includes an inflatable bladder adapted to expand the contact region into cooperative engagement with the engaging surface when oriented in the gripping condition.

28. The maneuvering tool according to claim 26, wherein said collet device of said gripping mechanism includes a plurality of finger members extending distally from said elongated shaft, and positioned generally radially around the collet longitudinal axis, the outer contact region of each said finger member collectively having a transverse cross-sectional dimension substantially conforming to the elliptical shape of the cavity opening, when in the release condition.

29. The maneuvering tool according to claim 28, wherein said gripping mechanism further includes a plunger mechanism having a plunger head disposed for relative reciprocating movement along the longitudinal axis of the collet device between a disengaged condition and an engaged condition wherein a cam surface of the plunger head contacts an opposed underside displacement surface of each finger member causing the respective contacting regions thereof to move radially outward from the release condition toward the gripping condition.

30. The maneuvering tool according to claim 29, wherein said collet device further includes a base portion, and each finger member is cantilever mounted to the base portion at a respective proximal location thereof for radial cantilever movement between the release condition and the gripping condition as the plunger head is axially displaced between the disengaged condition and the engaged condition.

31. The maneuvering tool according to claim 30, wherein each said finger member cooperates with the cam surface of the plunger head to displace the respective contact region of the finger member increasingly radially outward during relative movement as the plunger head is displaced axially along the longitudinal axis of the collet device toward the engaged condition.

32. The maneuvering tool according to claim 31, wherein the respective height of each finger member increases in thickness dimension from the proximal end to the distal end thereof to cause increasing gripping pressure between the collet device and the cleaning head as the plunger mechanism moves from the disengaged condition to the engaged condition.

33. The maneuvering tool according to claim 32, wherein said gripping mechanism includes a biasing device to bias the gripping mechanism toward the release condition.

34. The maneuvering tool according to claim 32, wherein said collet device is slideably mounted to said elongated shaft of the maneuvering tool, and the biasing device to urge the collet device toward the released condition.

35. The maneuvering tool according to claim 34, further including:

a force limiting device cooperating with said plunger mechanism to limit the force applied by the plunger head to said finger members and the head engaging surface.

36. The maneuvering tool according to claim 35, wherein said plunger mechanism is adapted for movement relative said shaft along the collet longitudinal axis between an extended condition, extending the plunger head away from said shaft, and a retracted condition, and said force limiting device includes a plunger biasing device biasing said plunger mechanism toward the extended condition.

37. A cleaning tool assembly comprising:

a disposable cleaning implement having a relatively rigid engaging surface;

an elongated shaft having a handle portion on one end thereof;

a gripping mechanism mounted to the elongated shaft, and including a contact region moveable between a gripping condition, wherein said contact region cooperates with said engaging surface of the cleaning implement to releasably mount the cleaning implement to the elongated shaft, and a release condition, wherein said cleaning implement is released from said gripping mechanism; and an elastic boot composed of a substantially liquid impervious material and configured to extend substantially over said contact region of the gripping mechanism such that when said gripping mechanism is in the gripping condition, said contact region urges said elastic boot against said engaging surface of said cleaning implement to form a substantially liquid-tight seal therebetween to substantially delay liquid contact with said engaging surface during liquid immersion and use of the cleaning implement.

38. The cleaning tool assembly according to claim 37, wherein said cleaning implement is at least partially liquid soluble or liquid dispersible.

39. The cleaning tool assembly according to claim 38, wherein said engaging surface of the cleaning implement defining a gripping cavity having an elliptical-shaped opening therein.

40. The cleaning tool assembly according to claim 39, wherein said collet device of said gripping mechanism is adapted to radially contact a backside surface of the boot, in said gripping condition, in a manner exerting substantially uniform pressure radially outward on the head engaging surface.

41. The cleaning tool assembly according to claim 40, wherein said collet device of said gripping mechanism includes a plurality of finger members extending distally from said shaft, and positioned generally radially around the longitudinal axis of the collet device, the outer contact region of each said finger member collectively having a transverse cross-sectional dimension substantially conforming to the elliptical shape of the cavity opening, when in the release condition.

42. The cleaning tool assembly according to claim 41, wherein said gripping mechanism further includes a plunger mechanism having a plunger head disposed for relative reciprocating movement along the longitudinal axis of the collet device between a disengaged condition and an engaged condition wherein a cam surface of the plunger head contacts an opposed underside displacement surface of the finger member causing the respective contacting regions thereof to move radially outward from the release condition toward the gripping condition.

43. The cleaning tool assembly according to claim 42, wherein said collet device further includes a base portion, and each finger member is cantilever mounted to the base portion at a respective proximal location thereof for radial cantilever movement between the release condition and the gripping condition as the plunger head is axially displaced between the disengaged condition and the engaged condition.

44. The cleaning tool assembly according to claim 43, wherein each said finger member cooperates with the cam surface of the plunger head to displace the respective contact region of the finger member increasingly radially outward during relative movement as the plunger head is displaced axially along the longitudinal axis of the collet device toward the engaged condition.

45. The cleaning tool assembly according to claim 44, wherein the respective height of each finger member increases in thickness dimension from the proximal end to the distal end thereof to cause increasing gripping pressure between the collet device and the cleaning head as the plunger mechanism moves from the disengaged condition to the engaged condition.

46. The cleaning tool assembly according to claim 41, further including:

a latch mechanism cooperating with the plunger mechanism and collet device to lock the gripping mechanism in the gripping condition.

47. The cleaning tool assembly according to claim 41, further including:

a force limiting device cooperating with said plunger mechanism to limit the force applied by the plunger head to said finger members and the head engaging surface.

48. The cleaning tool assembly according to claim 47, wherein said plunger mechanism is adapted for movement relative said shaft along the collet longitudinal axis between an extended condition, extending the plunger head away from said shaft, and a retracted condition, and said force limiting device includes a plunger biasing device biasing said plunger mechanism toward the extended condition.

49. The cleaning tool assembly according to claim 48, wherein said plunger mechanism is slideably mounted to a bracket of the shaft for axial movement between the retracted condition and the extended condition, and said plunger biasing device includes a compression spring positioned between the plunger mechanism and the bracket to bias the plunger head toward the extended condition.

50. The cleaning tool assembly according to claim 38, wherein said gripping mechanism includes a biasing device to bias the gripping mechanism toward the release condition.

51. The cleaning tool assembly according to claim 50, wherein said biasing device includes a compression spring.

52. The cleaning tool assembly according to claim 50, wherein said collet device is slideably mounted to said elongated shaft of the cleaning tool, and the biasing device to urge the collet device toward the released condition.

53. A cleaning device comprising:

a disposable, cleaning head including a support surface defining an elliptical-shaped opening into a gripping cavity thereof, said gripping cavity further defined by a back wall and a relatively rigid, inwardly facing, side engaging surface extending between the support surface and the back wall;

an elongated shaft having a handle portion on one end thereof;

said engaging surface of the cleaning head defining a gripping cavity having an elliptical-shaped opening therein;

an internal gripping mechanism mounted to the elongated shaft, and including a collet device having an expansive, circumferential, outward facing contact region sized and dimensioned for sliding insertion through the elliptical-shaped opening and into the gripping cavity when oriented in a release condition, said gripping mechanism selectivity movable between the release condition and a gripping condition wherein the outward facing contact region is displaced radially outward from a longitudinal axis of the collet device and into gripping cooperation with the inwardly facing, side engaging surface to provide a substantially uniform engaging force therebetween for mounting of the cleaning head during operation;

wherein said cleaning head is at least partially liquid soluble or liquid dispersible;

wherein said engaging surface of the cleaning head defines a gripping cavity having an elliptical-shaped opening therein;

a force limiting device cooperating with the gripping mechanism to limit the uniform engaging force applied to the side engaging surface of the cleaning head by the collet contact region, and;

an elastic boot composed of a substantially liquid impervious material and configured to extend substantially over said contact region of the gripping mechanism such that when said gripping mechanism is in the gripping condition, said contact region urges said elastic boot against said engaging surface of said cleaning head to if form a substantially liquid-fight seal therebetween to substantially delay solubility of said engaging surface during liquid immersion and use of the cleaning head.

54. The cleaning device according to claim 53, wherein said collet device of said gripping mechanism is adapted to radially contact a backside surface of the boot, in said gripping condition, in a manner exerting substantially uniform pressure radially outward on the head engaging surface.

55. The cleaning device according to claim 54, wherein said collet device of said gripping mechanism includes a plurality of finger members extending distally from said shaft, and positioned generally radially around the longitudinal axis of the collet device, the outer contact region of each said finger member collectively having a transverse cross-sectional dimension substantially conforming to the elliptical shape of the cavity opening, when in the release condition.

56. The cleaning device according to claim 55, wherein said gripping mechanism further includes a plunger mechanism having a plunger head disposed for relative reciprocating movement along the longitudinal axis of the collet device between a disengaged condition and an engaged condition wherein a cam surface of the plunger head contacts an opposed underside displacement surface of the finger member causing the respective contacting regions thereof to move radially outward from the release condition toward the gripping condition.

57. The cleaning device according to claim 56, wherein said collet device further includes a base portion, and each finger member is cantilever mounted to the base portion at a respective proximal location thereof for radial cantilever movement between the release condition and the gripping condition as the plunger head is axially displaced between the disengaged condition and the engaged condition.

58. The cleaning device according to claim 57, wherein each said finger member cooperates with the cam surface of the plunger head to displace the respective contact region of the finger member increasingly radially outward during relative movement as the plunger head is displaced axially along the longitudinal axis of the collet device toward the engaged condition.

59. The cleaning device according to claim 58, wherein the respective height of each finger member increases in thickness dimension from the proximal end to the distal end thereof to cause increasing gripping pressure between the collet device and the cleaning head as the plunger mechanism moves from the disengaged condition to the engaged condition.

60. The cleaning device according to claim 56, further including:

a latch mechanism cooperating with the plunger mechanism and collet device to lock the gripping mechanism in the gripping condition.

61. The cleaning device according to claim 60, further including:

a release mechanism cooperating with the latch mechanism and the biasing device to release the gripping mechanism from the gripping condition.

* * * * *